US007668476B2

(12) United States Patent
Kasai et al.

(10) Patent No.: US 7,668,476 B2
(45) Date of Patent: Feb. 23, 2010

(54) IMAGE FORMING APPARATUS CAPABLE OF REDUCING DISAGREEABLE ODOR AND VOLATILE ORGANIC COMPOUNDS

(75) Inventors: Kokichi Kasai, Kanagawa (JP); Kazuyo Ehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 477 days.

(21) Appl. No.: 11/588,285

(22) Filed: Oct. 27, 2006

(65) Prior Publication Data

US 2007/0121142 A1 May 31, 2007

(30) Foreign Application Priority Data

Nov. 25, 2005 (JP) ..... P2005-340002
Jul. 31, 2006 (JP) ..... P2006-208412

(51) Int. Cl.
*G03G 15/00* (2006.01)

(52) U.S. Cl. ..... 399/93

(58) Field of Classification Search ..... 347/101; 399/410, 93, 407; 258/1.12; 271/278
See application file for complete search history.

(56) References Cited

U.S. PATENT DOCUMENTS

| | | | | |
|---|---|---|---|---|
| 5,771,103 | A * | 6/1998 | Ogino | 358/437 |
| 6,094,549 | A * | 7/2000 | Hiraoka et al. | 399/93 |
| 6,327,447 | B1 | 12/2001 | Nakano et al. | 399/92 |
| 7,003,242 | B2 | 2/2006 | Kida | 399/92 |
| 7,020,411 | B2 | 3/2006 | Awaya | |
| 7,027,752 | B2 | 4/2006 | Yon et al. | 399/93 |
| 7,136,613 | B2 | 11/2006 | Sato et al. | 399/92 X |
| 7,274,892 | B2 | 9/2007 | Awaya | |
| 7,313,342 | B2 | 12/2007 | Katayama et al. | 399/93 |
| 2005/0135835 | A1 | 6/2005 | Park et al. | |
| 2007/0110469 | A1 | 5/2007 | Kasai | 399/93 |
| 2007/0139731 | A1 | 6/2007 | Saito | |

FOREIGN PATENT DOCUMENTS

| | | |
|---|---|---|
| CN | 1630836 A | 6/2005 |
| JP | 2002-91270 | 3/2002 |
| JP | 2002-123138 | 4/2002 |
| JP | 2003-295740 | 10/2003 |
| JP | 2004-240270 | 8/2004 |
| JP | 2005-126191 | 5/2005 |
| JP | 2005-338675 | 12/2005 |
| WO | WO 03/069415 | 8/2003 |

OTHER PUBLICATIONS

Yasunori Saito, "Image Forming Apparatus," Unpublished U.S. Appl. No. 11/582,503, filed Oct. 18, 2006.

* cited by examiner

*Primary Examiner*—Quana M Grainger
(74) *Attorney, Agent, or Firm*—Morgan, Lewis & Bockius LLP

(57) ABSTRACT

An image forming apparatus includes a main body, a post-processing unit, a transport unit, a filter and a suctioning/exhausting unit. The post-processing unit is disposed adjacent to the main body. The post-processing unit performs predetermined post-processing on a recording medium on which an image is formed in the main body. The transport unit transports the recording medium from the main body to the post-processing unit. The suctioning/exhausting unit suctions air in the transport unit and exhausts the suctioned air through the filter to an outside of the main body.

12 Claims, 13 Drawing Sheets

IMAGE FORMING APPARATUS CAPABLE OF REDUCING DISAGREEABLE ODOR AND VOLATILE ORGANIC COMPOUNDS

BACKGROUND

Technical Field

The invention relates to an image forming apparatus such as an electrophotographic copying machine, printer, fax machine, or multifunction machine having a combination of these functions. In particular, the invention relates to an image forming apparatus capable of reducing disagreeable odor and VOC exhausted from an ejection portion for ejecting recording media such as sheets of paper to the outside of the image forming apparatus.

SUMMARY

According to an aspect of the invention, an image forming apparatus includes a main body, a post-processing unit, a transport unit, a filter and a suctioning/exhausting unit. The post-processing unit is disposed adjacent to the main body. The post-processing unit performs predetermined post-processing on a recording medium on which an image is formed in the main body. The transport unit transports the recording medium from the main body to the post-processing unit. The suctioning/exhausting unit suctions air in the transport unit and exhausts the suctioned air through the filter to an outside of the main body.

DETAILED DESCRIPTION

Exemplary embodiments of the invention will be described below with reference to the drawings.

First Exemplary Embodiment

Figure 2:
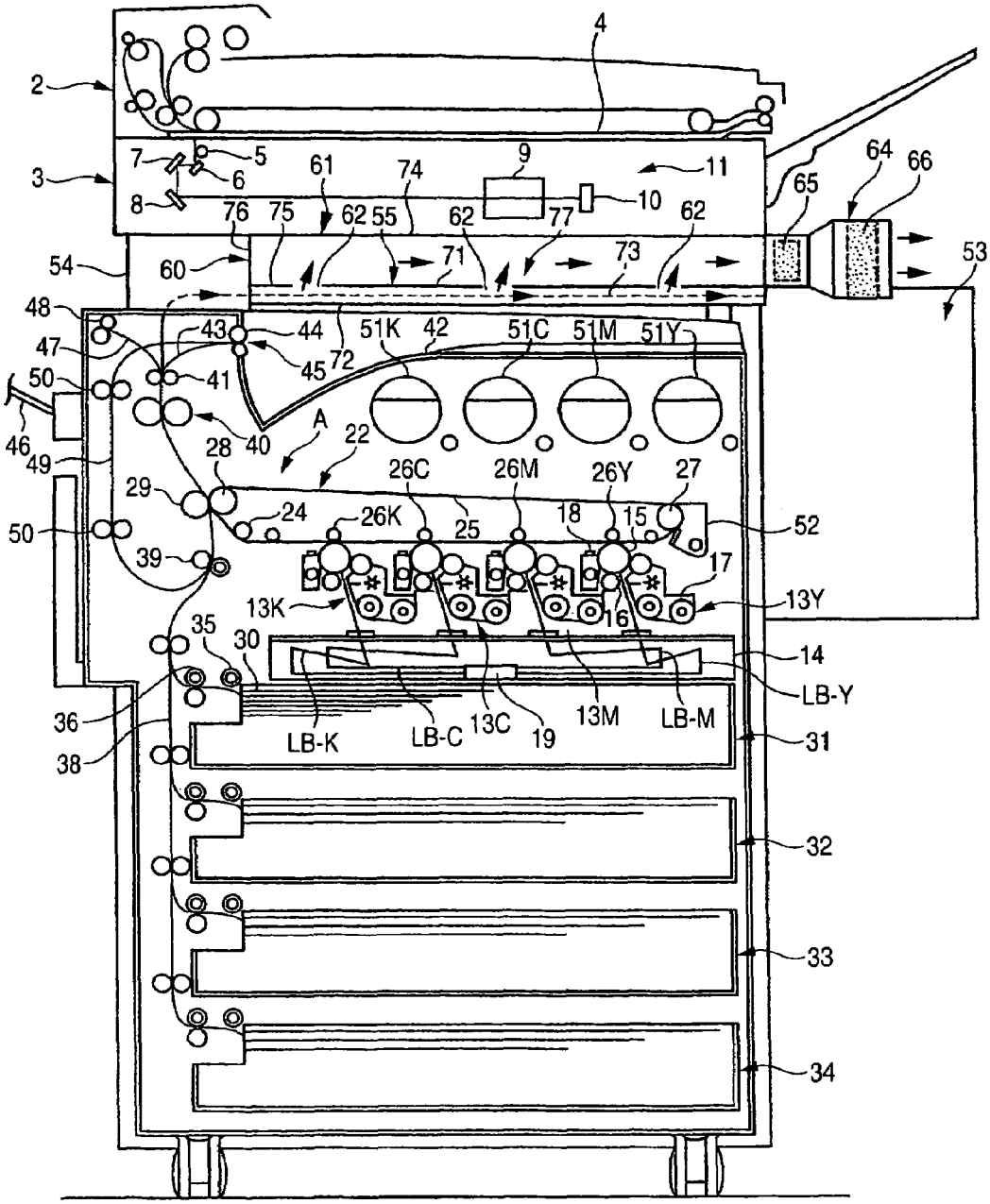
FIG. 2 is a configuration diagram illustrating the color multifunction machine, which serves as the image forming apparatus according to the first exemplary embodiment of the invention.

FIG. 2 is a configuration diagram showing a color multifunction machine, which serves as the image forming apparatus according to a first exemplary embodiment of the invention. This color multifunction machine has a combination of the functions of a copying machine, printer and fax machine.

As shown in FIG. 2, this color multifunction machine includes in its upper portion a scanner unit 3 as an image reading device and is connected to a personal computer or the like (not shown) over a network (not shown).

The above color multifunction machine is adapted to reproduce an image of a document read by the scanner unit 3, print an image based on image data sent from the personal computer, and function as a fax machine sending and receiving image data over a telephone line.

Figure 12:
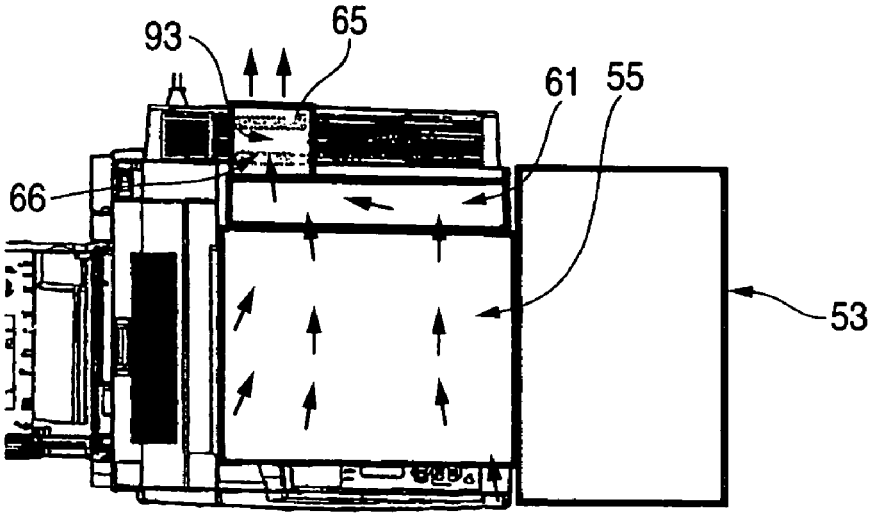
FIG. 12 is a configuration diagram illustrating the main part of a color multifunction machine, which serves as an image forming apparatus according to a fourth exemplary embodiment of the invention.
Figure 13:
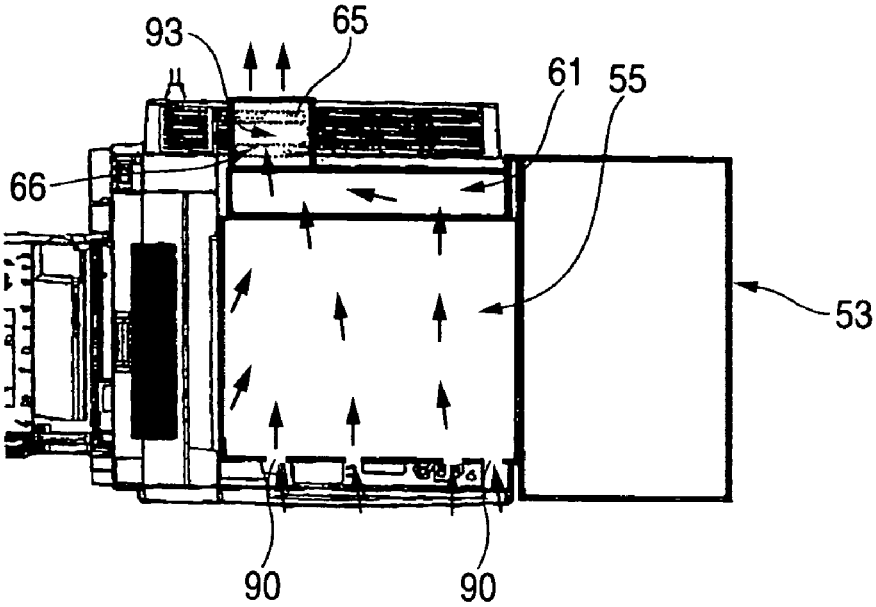
FIG. 13 is a configuration diagram illustrating the main part of a modified color multifunction machine, which serves as the image forming apparatus according to the fourth exemplary embodiment of the invention.
Figure 14:
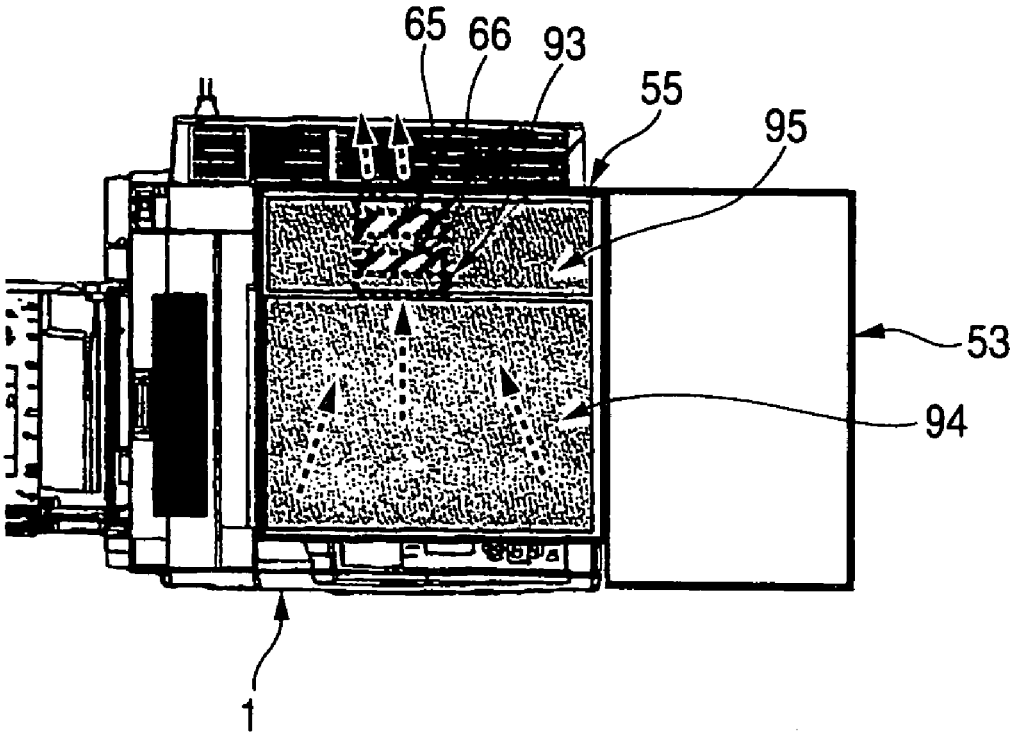
FIG. 14 is a configuration diagram illustrating the main part of a color multifunction machine, which serves as an image forming apparatus according to a fifth exemplary embodiment of the invention.

Also, the color multifunction machine includes on its front side an operation section 100 for allowing a user to input an instruction into the color multifunction machine (see FIGS. 12 to 14). The operation section 100 may include a touch panel and plural keys or buttons.

In FIG. 2, reference number 1 denotes the body of the color multifunction machine. In the upper portion of the main body 1 of the color multifunction machine are disposed an automatic document feeder (ADF) 2 for automatically transporting documents (not shown) separately on a one-by-one basis and the scanner unit 3 for reading an image of a document transported by the automatic document feeder 2. The scanner unit 3 is configured to illuminate the document placed on a platen glass 4 with a light source 5, project the reflected light image from the document in a scanning manner through a reduction optical system 11 including a full rate mirror 6, half rate mirrors 7, 8, and an imaging lens 9 onto an image reading element 10 such as a CCD, and read the reflected light image of colored materials of the document with the image reading element 10 at a predetermined dot density (16 dot/mm, for example).

The reflected light image of the document read by the scanner unit 3 is sent to an image processing system (IPS) (not shown), for example, in the form of 3-color reflectance data of red (R), green (G), and blue (B), each having 8-bit resolution. The image processing system provides, as required, predetermined image processing on the image data of the document, including shading correction, misalignment correction, brightness/color space conversion, gamma correction, frame deletion, and color/motion editing, which will be described later. The image processing system also provides the predetermined image processing on image data sent from the personal computer or the like (not shown).

The image data having undergone the predetermined image processing in the image processing system is converted into 4-color gradation data in the same image processing system, the 4-color data consisting of yellow (Y), magenta (M), cyan (C) and black (K), each having 8-bit resolution. The 4-color gradation data is, as will be described later, sent to a ROS 14 (Raster Output Scanner) common to image forming units 13Y, 13M, 13C and 13K for yellow (Y), magenta (M), cyan (C) and black (K), respectively. The ROS 14 as an image exposure device performs an image exposure process using a laser light LB based on the gradation data of a predetermined color. In this color image forming process, only a black and white image may of course be produced.

As shown in FIG. 2, inside the main body 1 of the color multifunction machine is disposed image forming means A, in which four image forming units 13Y, 13M, 13C and 13K for yellow (Y), magenta (M), cyan (C) and black (K), respectively, are horizontally located side-by-side and spaced apart by a fixed distance.

These four image forming units 13Y, 13M, 13C and 13K are all similarly configured with respect to each other and each unit includes, broadly speaking, a photosensitive drum 15 as an image carrier driven at a predetermined rotational speed, a primary charging roll 16 for uniformly charging the surface of the photosensitive drum 15, the common ROS 14 as the image exposure device for exposing an image corresponding to a predetermined color to form an electrostatic latent image on the surface of the photosensitive drum 15, a developing unit 17 for developing the electrostatic latent image formed on the photosensitive drum 15 by applying the predetermined color toner thereto, and a cleaning unit 18 for cleaning the surface of the photosensitive drum 15. The photosensitive drum 15 and the other image forming members located therearound are integrally unitized and the unit is separately and removably attached to the main body 1 of the color multifunction machine.

As shown in FIG. 2, the ROS 14 common to the four image forming units 13Y, 13M, 13C and 13K modulates four semiconductor lasers (not shown) based on respective color gradation data to output laser light LB-Y, LB-M, LB-C and LB-K from these semiconductor lasers based on respective gradation data. The ROS 14 may of course be separately provided for each of the plurality of image forming units. The laser light LB-Y, LB-M, LB-C and LB-K emitted from these semiconductor lasers pass through an f-θ lens (not shown) and are incident on a polygonal mirror 19, which deflects and scans the laser light. Each laser light LB-Y, LB-M, LB-C and LB-K deflected and scanned by the polygonal mirror 19 is projected diagonally from the lower side through an imaging lens and a plurality of mirrors (not shown) to an exposure point on the photosensitive drum 15 in a scanning manner.

As shown in FIG. 2, since the ROS 14 projects images upwardly onto the photosensitive drums 15 in a scanning manner, developing units 17 in the four image forming units 13Y, 13M, 13C and 13K located above the ROS 14 could drop the toner and the like and contaminate the ROS 14. To avoid such a problem, the ROS 14 is enclosed and sealed by a rectangular box-like frame 20, on top of which transparent glass windows 21Y, 21M, 21C and 21K are provided as shielding members, through which the four laser light LB-Y, LB-M, LB-C and LB-K are projected on the photosensitive drums 15 in the image forming units 13Y, 13M, 13C and 13K.

The image data processing system sequentially outputs color image data to the ROS 14 common to the image forming units 13Y, 13M, 13C and 13K for yellow (Y), magenta (M), cyan (C) and black (K), respectively, and the ROS 14 projects each of the laser light LB-Y, LB-M, LB-C and LB-K based on respective image data onto the surface of corresponding photosensitive drum 15 in a scanning manner to form an electrostatic latent image. The electrostatic latent images formed on the photosensitive drums 15 are developed by the developing units 17Y, 17M, 17C and 17K into yellow (Y), magenta (M), cyan (C) and black (K) toner images.

The yellow (Y), magenta (M), cyan (C) and black (K) toner images sequentially formed on the photosensitive drums 15 of the image forming units 13Y, 13M, 13C and 13K are transferred in a multilayered manner by four primary transfer rolls 26Y, 26M, 26C and 26K onto an intermediate transfer belt 25 as an endless belt member of a transfer unit 22 located over the image forming units 13Y, 13M, 13C and 13K. The primary transfer rolls 26Y, 26M, 26C and 26K are disposed on the back side of the intermediate transfer belt 25 at the positions corresponding to the respective photosensitive drums 15 of the image forming units 13Y, 13M, 13C and 13K. The primary transfer rolls 26Y, 26M, 26C and 26K in this exemplary embodiment are prepared to have a volume resistivity of $10^5$ to $10^8$ Ω-cm. The primary transfer rolls 26Y, 26M, 26C and 26K are connected to a transfer bias power supply (not shown), which applies a transfer bias with a polarity (positive polarity in this exemplary embodiment) opposite to a predetermined toner polarity at a predetermined timing.

As shown in FIG. 2, the intermediate transfer belt 25 with a fixed tension engages a drive roll 27, a tension roll 24, and a backup roll 28, and is driven at a predetermined speed in a circulating manner in the direction indicated by the arrow using the drive roll 27 rotationally driven by a dedicated drive motor (not shown) that is excellent in keeping a constant speed. The intermediate transfer belt 25 is, for example, formed of an anti charge-up belt material (rubber or resin).

As shown in FIG. 2, the yellow (Y), magenta (M), cyan (C) and black (K) toner images transferred on the intermediate transfer belt 25 in a multilayered manner are secondarily transferred on a sheet of paper 30 as a recording medium by a secondary transfer roll 29 that is pressed onto the backup roll 28, and the sheet 30 on which the color toner images were transferred is transported to a fixing unit 40 located above. The secondary transfer roll 29 is located sideways of and pressed onto the backup roll 28 and adapted to secondarily transfer the color toner images on the sheet 30 transported upward.

In the lower portion of the main body 1 of the color multifunction machine are disposed multi-tiered sheet feed trays 31, 32, 33 and 34, one of which feeds the sheet 30 of a predetermined size through a feed roll 35, retard roll 36 and the like separately on a one-by-one basis along a sheet transport path 38 provided with a transport roll 37 therealong. The sheet 30 fed from one of the sheet feed trays 31, 32, 33 and 34 reaches a resist roll 39 and temporarily stays there. The resist roll 39 then resumes transporting the sheet 30 to the secondary transfer position on the intermediate transfer belt 25 in synchronization with the image thereon.

As shown in FIG. 2, the sheet 30 on which the color toner images have been transferred undergoes a fixing process in which heat and pressure are applied by the fixing unit 40. Then, the sheet 30 is transported by a transfer roll 41 through a first sheet transport path 43 for ejecting the sheet 30 to a face-down tray 42, which serves as a recording-medium stacking portion, with the surface on which the image is formed facing downward. The sheet 30 is then ejected by an ejection roll 44 provided at the exit of the first sheet transport path 43 on the face-down tray 42 provided in the upper portion of the apparatus body 1. The portion where the ejection roll 44 is provided in the main body 1 of the color multifunction machine forms a sheet ejection portion 45, which serves as a recording-medium ejection portion for ejecting sheets of paper 30 to the face-down tray 42.

The face-down tray 42, which serves as the recording-medium stacking portion, is provided inside a body formed of the main body 1 of the image forming apparatus and the scanner unit 3, which is located in the upper portion of the main body 1 of the image forming apparatus.

To eject the sheet 30 on which an image was thus formed with the imaged surface facing upward, the sheet 30 is transported through a second sheet transport path 47 for ejecting the sheet 30 on a face-up tray 46, which serves as a second sheet catch tray, with the imaged surface facing upward, and ejected by an ejection roll 48 provided at the exit of the second sheet transport path 47 on the face-up tray 46 provided on the side of the main body 1 of the color multifunction machine (the left side in the figure), as shown in FIG. 2.

To produce, for example, a full-color double-sided copy in the color multifunction machine, the sheet 30 with an image fixed on one side is not simply ejected by the ejection roll 44 on the face-down tray 42 but is transported to a sheet transport path for producing double-sided copies 49 by temporarily stopping the ejection roll 44, switching the transport direction by a switching gate (not shown), and counterrotating the ejection roll 44, as shown in FIG. 2. The sheet 30 is transported through the sheet transport path for producing double-sided copies 49 by a transport roll 50 provided therealong to the resist roll 39 for the second time but the sheet 30 is turned upside-down this time. Another image is transferred and fixed on the other side of the sheet 30, which is then ejected either through the first sheet transport path 43 or second sheet transport path 47 on the face-down tray 42 or face-up tray 46.

In FIG. 2, reference numbers 51Y, 51M, 51C and 51K denote toner cartridges that supply predetermined color toners to the developing units 17 for yellow (Y), magenta (M), cyan (C) and black (K), and reference number 52 denotes a cleaning unit that removes residual toner and the like from the intermediate transfer belt 25.

Figure 3:
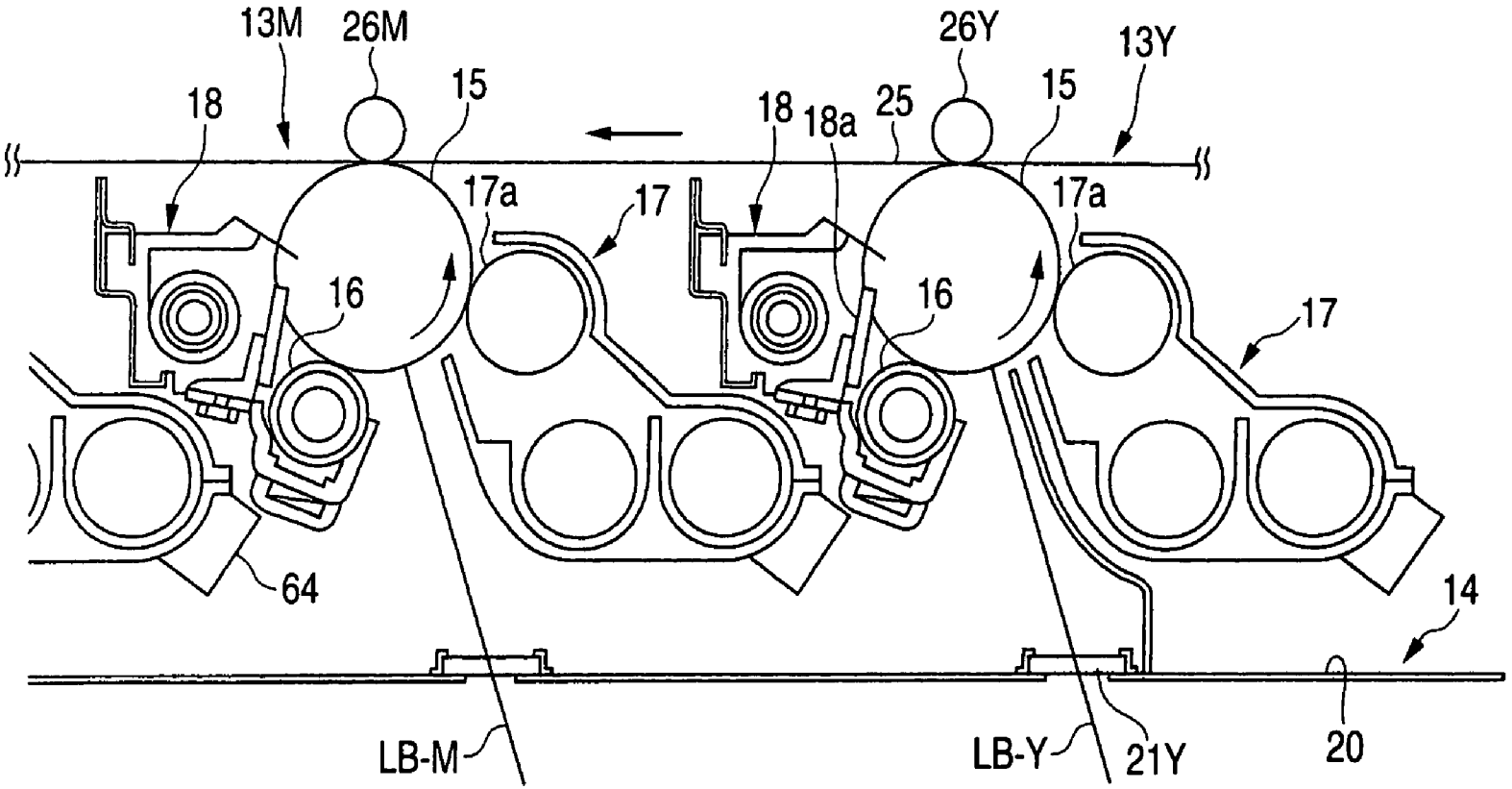
FIG. 3 is a configuration diagram illustrating image forming units of the color multifunction machine, which serves as the image forming apparatus according to the first exemplary embodiment of the invention.

FIG. 3 shows the image forming units of the color multifunction machine.

As shown in FIG. 3, the four image forming units 13Y, 13M, 13C and 13K for yellow, magenta, cyan and black are all similarly configured with respect to each other such that the four image forming units 13Y, 13M, 13C and 13K sequentially form yellow, magenta, cyan, and black toner images, respectively, at predetermined timings as described above. The image forming units 13Y, 13M, 13C and 13K for those colors, as described above, each includes the photosensitive drum 15, the surface of which is uniformly charged by the primary charging roll 16. Then, the surface of the photosensitive drum 15 receives the image forming laser light LB in a scanning manner outputted from the ROS 14 based on image data to form an electrostatic latent image corresponding to each color. The laser light LB projected on the photosensitive drums 15 in a scanning manner is designed to be projected not from directly under the photosensitive drum 15 but diagonally from a slightly rightward position. Developing rolls 17*a* of the developing units 17 in the image forming units 13Y, 13M, 13C and 13K apply yellow, magenta, cyan and black toners to the respective electrostatic latent images formed on the photosensitive drums 15 and convert them into visible toner images. The visible toner images are sequentially transferred in a multilayered manner by the charged primary transfer rolls 26 on the intermediate transfer belt 25.

After the toner image transfer process completes, the cleaning units 18 remove residual toner, paper particles and the like from the surfaces of the photosensitive drums 15 to make the surfaces ready for the next image forming process. Each of the cleaning units 18 has a cleaning blade 18*a*, which removes residual toner, paper particles and the like from the photosensitive drum 15.

In this first exemplary embodiment, an image forming apparatus includes a main body, a post-processing unit, a transport unit, a filter and a suctioning/exhausting unit. The post-processing unit is disposed adjacent to the main body. The post-processing unit performs predetermined post-processing on a recording medium on which an image is formed in the main body. The transport unit transports the recording medium from the main body to the post-processing unit. The suctioning/exhausting unit suctions air in the transport unit and exhausts the suctioned air through the filter to an outside of the main body.

Also, a suction port is formed in an upper surface of the transport unit. The suctioning/exhausting unit suctions the air in the transport unit through the suction port.

Also, the image forming apparatus further includes a tray and a recording-medium ejection portion. The recording-medium ejection portion is disposed above the transport unit. The recording-medium ejection portion ejects the recording medium to the tray. The suctioning/exhausting unit suctions air from a vicinity of the recording-medium ejection portion through the suction port.

Figure 1:
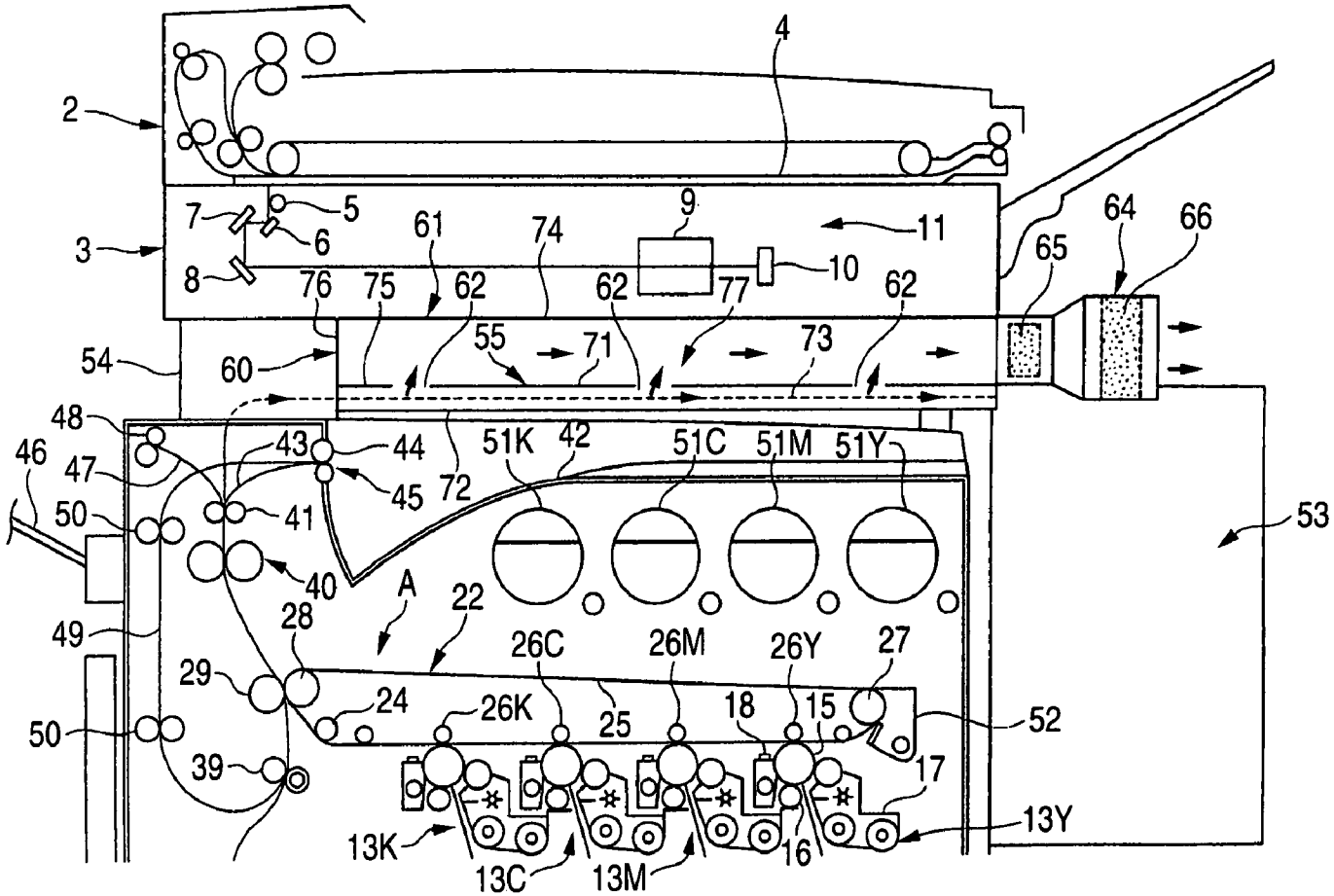
FIG. 1 is a configuration diagram illustrating the main part of a color multifunction machine, which serves as an image forming apparatus according to a first exemplary embodiment of the invention.

Also, the image forming apparatus includes a recording-medium inverting portion that inverts a recording medium having an image formed on one surface thereof. The suctioning/exhausting unit suctions air in the recording-medium inverting portion through the suction port Specifically, as shown in FIGS. 1 and 2, a post-processing device 53 is disposed on the right side of the color multifunction machine. The post-processing device 53 performs post-processing such as perforating and binding on a sheet of paper 30 on which an image is formed by the color multifunction machine. To perform the post-processing on the sheet 30 on which an image is formed by the image forming unit A of the color multifunction machine, the transport roll 41 transports just upward the sheet 30 on which the image is formed. The sheet 30 is introduced via a transport direction switch-over unit 54, which is located above the sheet ejection portion 45, into a transport unit 55 that transports the sheet 30 to the post-processing device 53. Then, the sheet 30 is transported via the transport unit 55 to the post-processing device 53.

The transport unit 55 has a top plate 71 and a bottom plate 72 placed in parallel and spaced apart by a predetermined distance to form a sheet transport passage 73 between the top plate 71 and bottom plate 72. In the passage 73, transport rolls (not shown) are provided to transport the sheet 30.

A suctioning/exhausting unit 60 is disposed on the top of the transport unit 55. The suctioning/exhausting unit 60 suctions air in the transport unit 55 and exhausts the suctioned air through a filter to the outside of the main body 1 of the color multifunction machine.

As shown in FIGS. 1 and 2, the suctioning/exhausting unit 60 includes a suction duct 61, which overlaps the top of the transport unit 55. The suction duct 61 includes a top plate 74 and a bottom plate 75 parallel to each other and side plates 76 surrounding the outer periphery of the suction duct 61. The top plate 74, the bottom plate 75 and the side plates 76 may be made of metal plates. The suction duct 61 has a flat box shape of a predetermined height and defines a hollow interior 77 therein. The bottom plate 75 of the suction duct 61 and the top plate 71 of the transport unit 55 are not necessarily separate plates but either of them may of course serve as the other.

Figure 4:
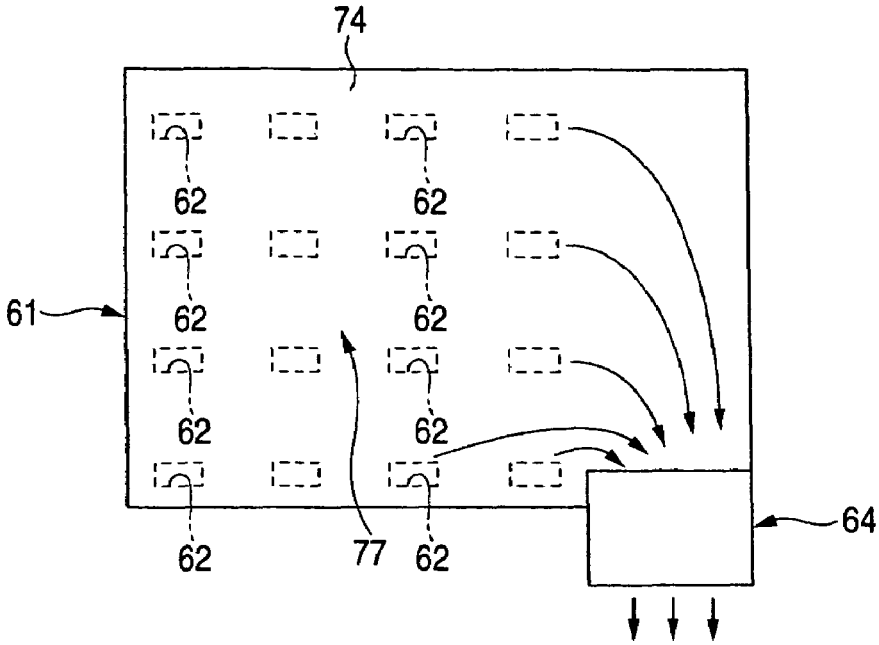
FIG. 4 is a configuration diagram illustrating suction ports of a suction duct.

As shown in FIGS. 2 and 4, plural suction ports 62, which are used to suction the air in the transport unit 55, in the top plate 71 of the transport unit 55 and the bottom plate 75 of the suction duct 61. These suction ports 62 communicate with the interior 77 of the suction duct 61. The suction ports 62 may of course be oriented from a front side to a rear side. The "front side" is a side where the operation section 100 (see FIGS. 12 to 14) is disposed, in a direction, which is substantially perpendicular to a direction in which the transport unit 55 transports the recording medium and which is substantially parallel to a surface of the recording medium being transported. The "rear side" is an opposite side to the side (front side) where the operation section 100 is disposed. Alternatively, the suction ports 62 may be opened continuously in a direction perpendicular to the front-and-rear direction.

Figure 5:
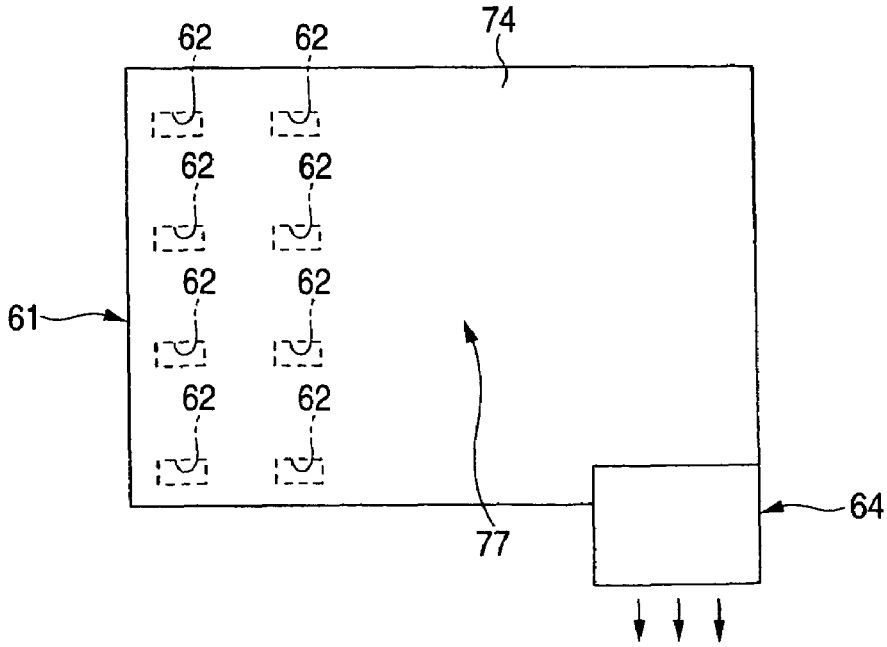
FIG. 5 is a configuration diagram illustrating the suction ports of the suction duct.

As shown in FIG. 5, the suction ports 62 of the suction duct 61 may be formed not only in the top plate 71 of the transport unit 55 and the bottom plate 75 of the suction duct 61 but also in the bottom plate 72 of the transport unit 55. In the bottom plate 72, the suction ports 62 may be concentrated on the front side (near side) of the sheet ejection portion 45 and the face-down tray 42.

In this case, not only the air in the transport unit 55 can be exhausted, but the air can be exhausted intensively from the suction ports 62 concentrated on the front side (near side) of the sheet ejection portion 45 and the face-down tray 42. Thus, even when a sheet of paper 30 being ejected onto the face-down tray 42 drops due to its own weight toward the face-down tray 42 and drives the air between the sheet 30 and the face-down tray 42 to the front side (near side) of the face-down tray 42, the displaced air to the front side (near side) of the face-down tray 42 can be effectively suctioned from the suction ports 62 concentrated on the front side (near side) of the sheet ejection portion 45.

Figure 6:
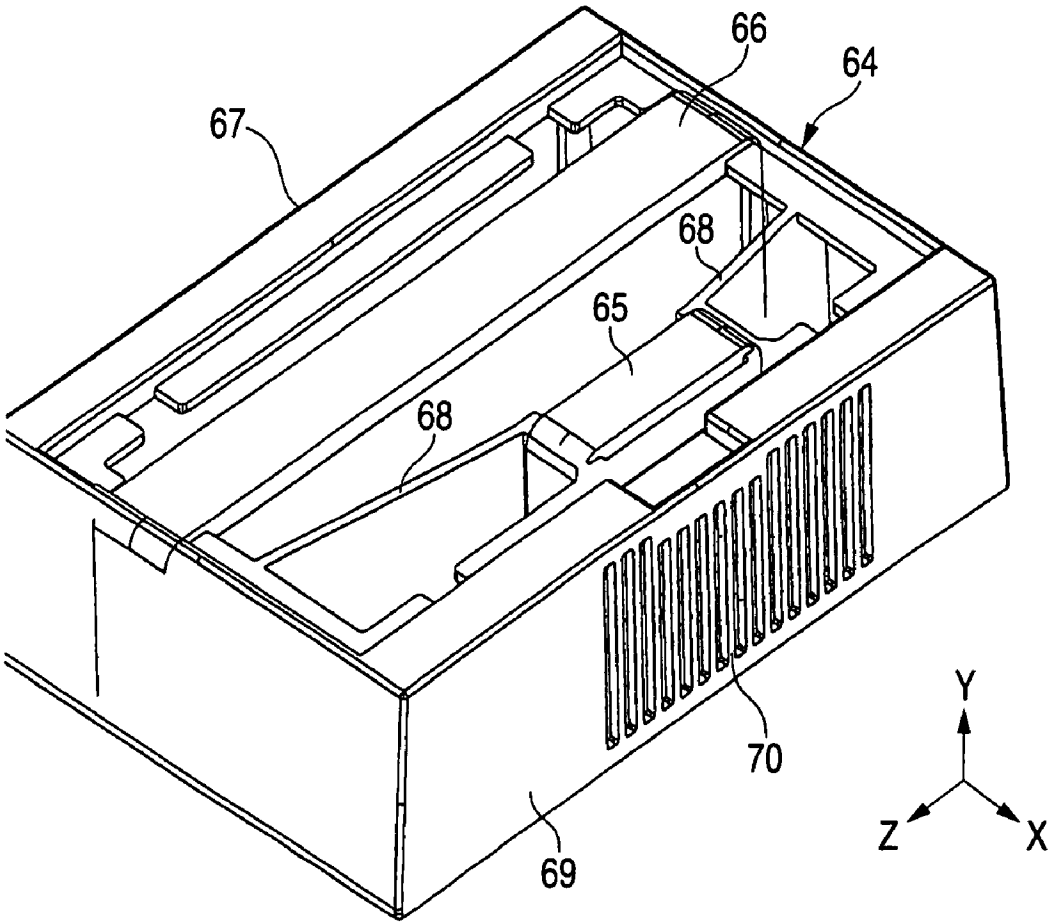
FIG. 6 is a perspective configuration diagram illustrating an exhaust portion.
Figure 7:
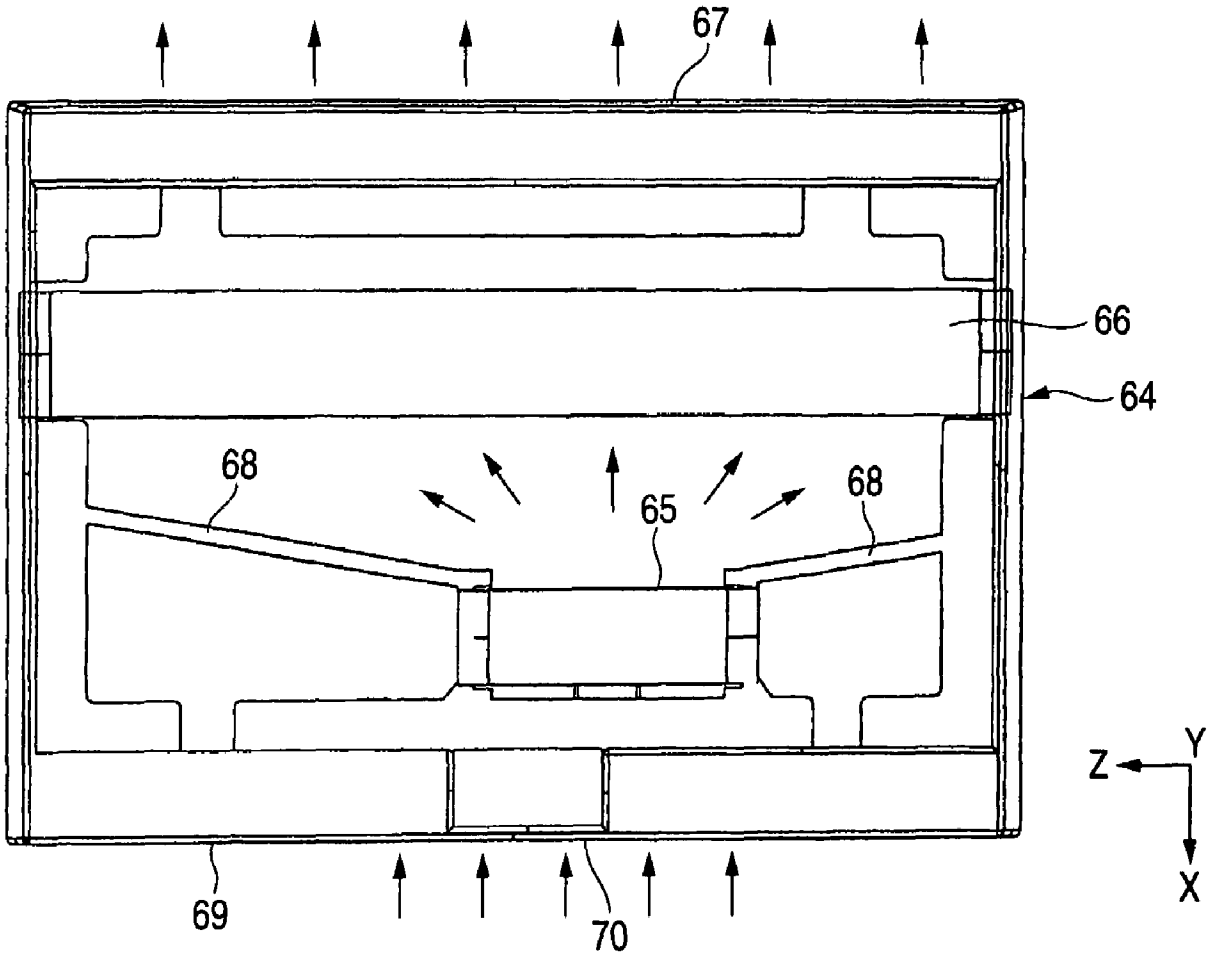
FIG. 7 is a cross-sectional configuration diagram illustrating the exhaust portion.

As shown in FIGS. 1 and 4, an exhaust portion 64 is attached to one side surface (right side surface) of the suction duct 61 on the rear side so as to communicate with the interior 77 of the suction duct 61. As shown in FIGS. 6 and 7, the exhaust portion 64 houses an exhaust fan 65 and a filter 66, and has a front surface 67 with louvers 70 in a suction section. The louvers 70 may of course be omitted. The interior of the exhaust portion 64 includes partition walls 68 to provide a wide space on the downstream side of the exhaust fan 65 so that the air discharged from the exhaust fan 65 flows across the filter 66. The air exhausted from the exhaust fan 65 spreads out and is then discharged through the filter 66 outside from louvers (not shown) provided in the rear surface 69 of the exhaust portion 64.

The filter 66 is formed of at least two selected from the group consisting of: (i) a deodorization filter, (ii) a filter for absorbing or decomposing a volatile organic compound and (iii) a filter for absorbing or decomposing ozone. In this exemplar embodiment, the filter 66 is formed of a deodorization filter and a filter for adsorbing or decomposing volatile organic compounds.

As will be described below, in the color multifunction machine configured as above according to this exemplary embodiment, the image forming apparatus in which the post-processing unit is attached to the apparatus body can prevent disagreeable odor and volatile organic compounds from escaping outside from the transport unit transporting recording media from the apparatus body to the post-processing unit and from affecting the environment where the apparatus is installed.

That is, in the color multifunction machine according to this exemplary embodiment, as shown in FIG. 2, the image forming units 13Y, 13M, 13C and 13K for yellow (Y), magenta (M), cyan (C) and black (K) form yellow (Y), magenta (M), cyan (C) and black (K) toner images, respectively, which are primarily transferred on the intermediate transfer belt 25 in a multilayered manner and then secondarily transferred as a whole image from the intermediate transfer belt 25 onto a sheet of paper 30.

The yellow (Y), magenta (M), cyan (C) and black (K) toner images transferred as a whole image onto the sheet 30 are fixed on the sheet 30 by heating and pressurizing thereof in the fixing unit 40. The sheet 30 is then ejected by the ejection roll 44 from the sheet ejection portion 45 on the face-down tray 42 as a sheet catch tray provided in the upper portion of the main body 1 of the color multifunction machine, which then completes the image forming process.

In this exemplary embodiment, as shown in FIGS. 1 and 2, adjacent to the main body 1 of the color multifunction machine is installed the post-processing device 53 to provide post-processing such as perforating, binding and the like on the sheet 30 on which the image has been formed in the color multifunction machine.

To perform the post-processing on the sheet 30 in the post-processing unit 53, as shown in FIG. 1, the sheet 30 on which the image has been formed in the color multifunction machine is not ejected from the sheet ejection portion 45 on the face-down tray 42 provided in the upper portion of the body of the multifunctional machine 1 but introduced into the transport unit 55 through the transport direction switch-over unit 54 located above the sheet ejection portion 45, and then transported through the transport unit 55 to the post-processing device 53. Thereafter, the post-processing unit 53 provides the predetermined post-processing such as perforating, binding and the like on the sheet 30.

When the yellow (Y), magenta (M), cyan (C) and black (K) toner images undergo a fixing process in which heat and pressure are applied to the sheet 30 in the fixing unit 40, disagreeable odor and volatile organic compounds (VOC) are produced from the toner and the like. As shown in FIG. 1, the odor and volatile organic compounds (VOC) produced from the toner and the like are discharged in the transport unit 55 as the sheet 30 is introduced in the transport unit 55 from the sheet ejection portion 45 through the transport direction switch-over unit 54.

In this exemplary embodiment, the suction ports 62 are provided in the top of the transport unit 55 and the suction duct 61 is disposed on the top of the transport unit 55. The image forming apparatus according to this exemplary embodiment is also configured to drive the exhaust fan 65 provided in the exhaust portion 64 of the suction duct 61.

In this exemplary embodiment, the exhaust fan 65 is driven in synchronization with the start of the image formation operation. The exhaust fan 65 continues to operate for a predetermined period after the image formation operation has completed.

Therefore, although the disagreeable odor and volatile organic compounds, which are produced when the unfixed toner images are fixed on the sheet 30 in the fixing unit 40, are discharged in the transport unit 55 as the sheet 30 moves, the odor and volatile organic compounds discharged in the transport unit 55 are immediately suctioned through the suction ports 62 of the suction duct 61, filtered out through the filter 66 provided in the exhaust portion 64 and discharged through the exhaust fan 65 to the outside of the main body 1 of the color multifunction machine, as shown in FIGS. 6 and 7.

Second Exemplary Embodiment

Figure 8:
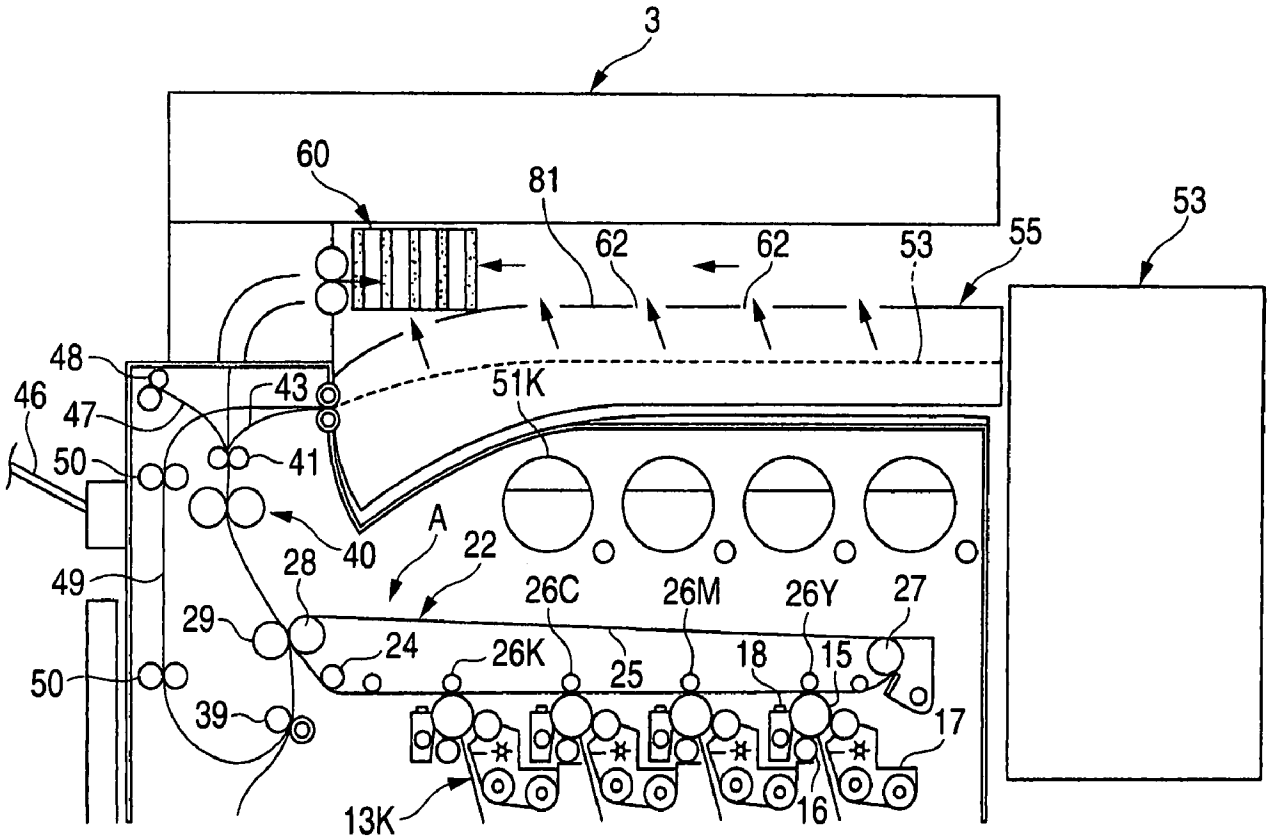
FIG. 8 is a configuration diagram illustrating the main part of a color multifunction machine, which serves as an image forming apparatus according to a second exemplary embodiment of the invention.

FIG. 8 shows a second exemplary embodiment of the invention. In the following description, the same parts as those of the first exemplary embodiment have the same reference signs. In the second exemplary embodiment, the transport unit is not located above the recording-medium stacking portion but at the position of the recording-medium stacking portion.

Specifically, in this exemplary embodiment, as shown in FIG. 8, the sheet 30 ejected by the ejection roll 44 to the face-down tray 42 is introduced into the transport unit 55 located at the position of the face-down tray 42. Then, the sheet 30 is transported through the interior 77 of the transport unit 55 to the post-processing unit 53.

The top of the transport unit 55 is formed into a curved shape so as to function as a face-down tray 81 in place of the regular face-down tray 42. Sheets of paper 30 are ejected onto the top of the transport unit 55 through the sheet transport direction change-over unit 54 using an auxiliary ejection roll 82 provided in the sheet transport direction change-over unit 54 instead of the ejection roll 44.

Furthermore, on the top plate 71, which forms the top side of the transport unit 55, are formed with suction ports 62, which are used to suction the air in the transport unit 55. A suctioning/exhausting unit 60 is disposed above the transport unit 55 and in the vicinity of the sheet ejection portion 45. The suctioning/exhausting unit 60 suctions the air from both the suction ports 62 of the transport unit 55 and the region above the transport unit 55.

The suctioning/exhausting unit 60 is not provided with a suction duct. However, the suctioning/exhausting unit 60 is configured to directly suction the air from both the suction ports 62 of the transport unit 55 and the region above the transport unit 55 and to exhaust the suctioned air through the filter 66 using the exhaust portion 64 as shown in FIGS. 6 and 7.

Since the other configurations and operation of this exemplary embodiment are similar to those of the previous exemplary embodiment, the description thereof will be omitted.

Third Exemplary Embodiment

Figure 9:
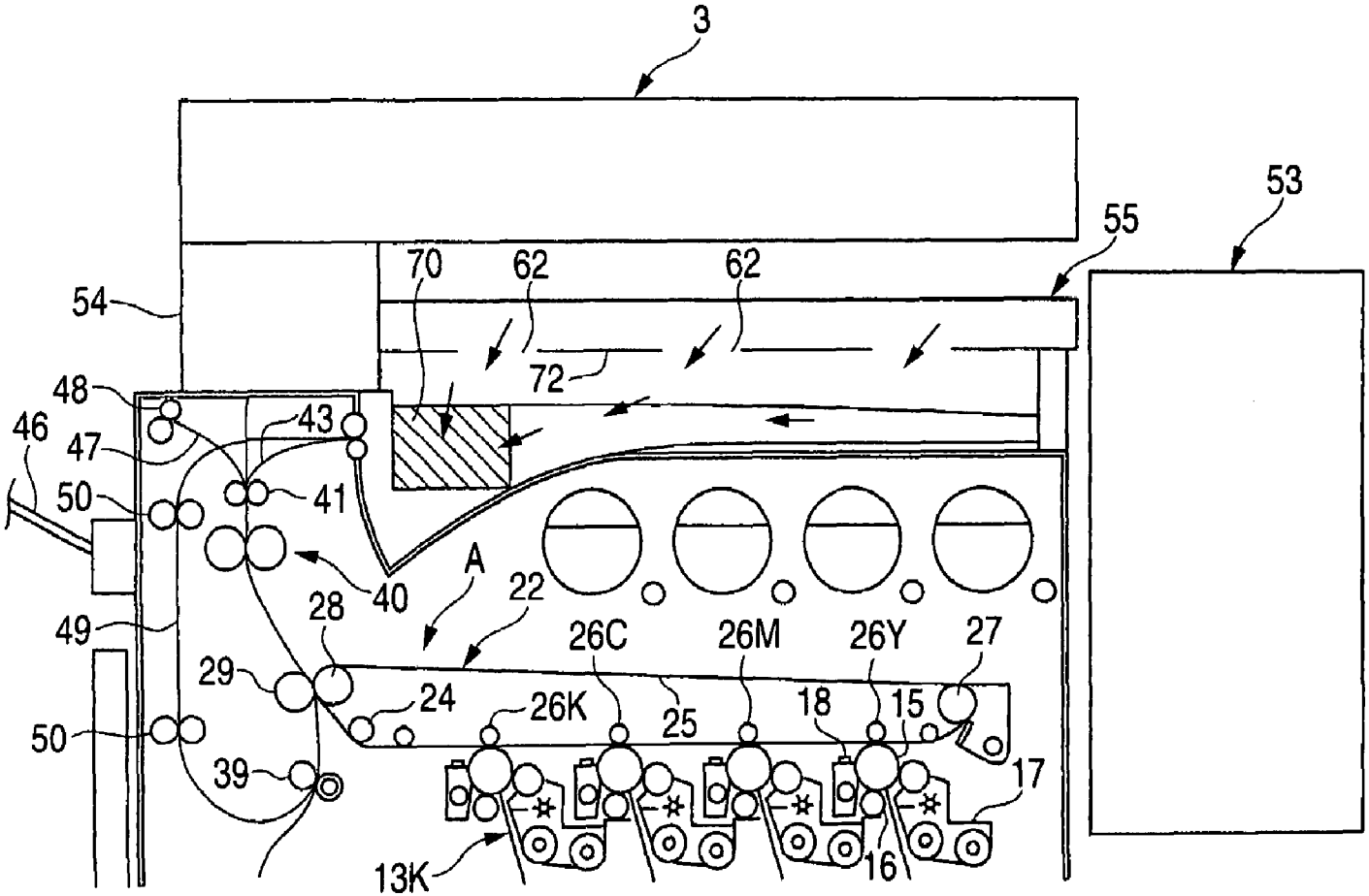
FIG. 9 is a configuration diagram illustrating the main part of a color multifunction machine, which serves as an image forming apparatus according to a third exemplary embodiment of the invention.

FIG. 9 shows a third exemplary embodiment of the invention. In the following description, the same parts as those of the first exemplary embodiment have the same reference signs. In the third exemplary embodiment, a suction port is formed in a bottom surface of the transport unit, and the suctioning/exhausting unit suctions the air in the transport unit through the suction port.

Furthermore, in this exemplary embodiment, the image forming apparatus further includes a tray and a recording-medium ejection portion disposed below the transport unit. The recording-medium ejection portion ejects the recording medium to the tray. The suctioning/exhausting unit suctions air from a vicinity of the recording-medium ejection portion through the suction port.

Also, the image forming apparatus further includes a recording-medium inverting portion that inverts a recording medium having an image formed on one surface thereof. The suctioning/exhausting unit suctions air in the recording-medium inverting portion through the suction port.

Specifically, in this exemplary embodiment, as shown in FIG. 9, although the transport unit 55 is disposed above the face-down tray 42 as in the first exemplary embodiment, plural suction ports 62 are formed not in the top of the transport unit 55 but in the bottom plate 72, which is the bottom surface of the transport unit 55.

Figure 10:
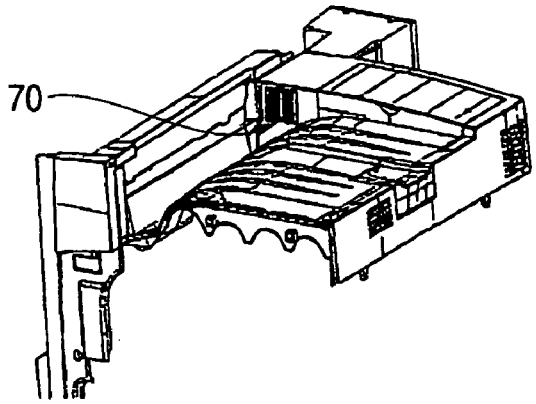
FIG. 10 is a configuration diagram illustrating the main part of a color multifunction machine, which serves as the image forming apparatus according to the third exemplary embodiment of the invention.

In this exemplary embodiment, as shown in FIG. 10, suction ports 70 of the ejecting unit 64 are provided on the far side (rear side) of the sheet ejection portion 45 and at the position corresponding to the face-down tray 42 of the main body 1 of the color multifunction machine. The suction port 70 of the main body 1 of the color multifunction machine suctions both the air in the region close to the sheet ejection portion 45, and the air from the plural suction ports 62 of the transport unit 55.

Figure 11:
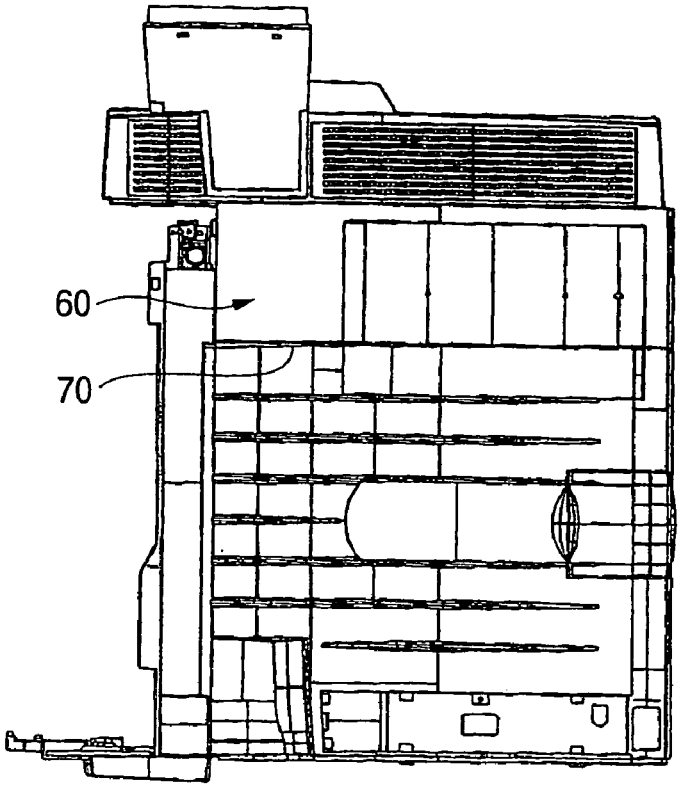
FIG. 11 is a configuration diagram illustrating the main part of the color multifunction machine, which serves as the image forming apparatus according to the third exemplary embodiment of the invention.

Furthermore, as shown in FIG. 11, a suction duct 61 for suctioning the air from the suction ports 70 is disposed inside the main body 1 of the color multifunction machine. The suction duct 61 houses an exhaust fan 65 and a filter 66.

Thus, in the third exemplary embodiment, as shown in FIG. 9, The air in the transport unit 55 is suctioned through the suction ports 62 formed in the bottom surface of the transport unit 55. Then, the exhaust fan 65 suctions the air, which is suctioned through the suction ports 62, from the suction ports 70 of the main body 1 of the color multifunction machine through the suction duct 61 disposed in the main body 1 of the color multifunction machine. Then, the exhaust fan 65 exhausts the suctioned air through the filter 66 to the outside of the main body 1 of the color multifunction machine.

For example, an exhaust fan for exhausting the air in the main body 1 of the color multifunction machine also serves as the exhaust fan 65.

The filter 66 is formed of at least two selected from the group consisting of: (i) a deodorization filter, (ii) a filter for absorbing or decomposing a volatile organic compound and (iii) a filter for absorbing or decomposing ozone. In this exemplar embodiment, the filter 66 is formed of three filters, that is, a deodorization filter, a filter for adsorbing or decomposing volatile organic compounds and a filter for absorbing or decomposing ozone.

The filter 66 may be a filter having at least two selected from the group consisting of: (i) a deodorization capability, (ii) a capability of absorbing or decomposing a volatile organic compound and (iii) a capability of absorbing or decomposing ozone.

Since the other configurations and operation of this exemplary embodiment are similar to those of the previous embodiments, the description thereof will be omitted.

Fourth Exemplary Embodiment

FIG. 12 shows a fourth exemplary embodiment of the invention. In the following description, the same parts as those of the first exemplary embodiment have the same reference signs. In the fourth exemplary embodiment, the suctioning/exhausting unit suctions the air in the transport unit from a rear side of the transport unit.

Specifically, in the fourth exemplary embodiment, as shown in FIG. 12, the air in the transport unit 55 is not suctioned from above or below the transport unit 55, but from the back (rear side) of the transport unit 55.

Suction ports 62 are formed in the back of the transport unit 55. A suction duct 61 is disposed on the back of the transport unit 55. The exhaust portion 64 suctions the air in the transport unit 55 through the suction duct 61 and exhausts the suctioned air to the outside of the main body 1 of the color multifunction machine through a filter 66.

As shown in FIG. 13, opening portions 90 may be formed in the front of the transport unit 55 so as to create in the transport unit 55 an air flow, which contributes to efficient suctioning while suctioning the outside air through the opening portions 90.

Since the other configurations and operation of this exemplary embodiment are similar to those of the above embodiments, the description thereof will be omitted.

Fifth Exemplary Embodiment

FIG. 14 shows a fifth exemplary embodiment of the invention. In the following description, the same parts as those of the first exemplary embodiment have the same reference signs. In the fifth exemplary embodiment, the image forming apparatus includes an exhaust fan disposed in the transport unit. The filter is disposed in the transport unit. The suctioning/exhausting unit exhausts the air in the transport unit, through the filter.

Specifically, in the fifth exemplary embodiment, as shown in FIG. 14, the transport unit 55 includes an exhaust fan 65 and a filter 66. Air in the transport unit 55 is exhausted to the outside of the color multifunction machine through the filter 66. The exhaust fan 65, filter 66 and duct 93 are disposed in space 95 where a drive system that drives transport rolls (not shown) is located. The space 95 is provided on the rear side of the transport passage space 94 of the transport unit 55.

In this case, a filter is not required in the main body 1 of the color multifunction machine. Therefore, the transport unit 55 itself can be used for other models of image forming apparatus.

Since the other configurations and operation of this exemplary embodiment are similar to those of the above embodiments, the description thereof will be omitted.

Sixth Exemplary Embodiment

Figure 15:
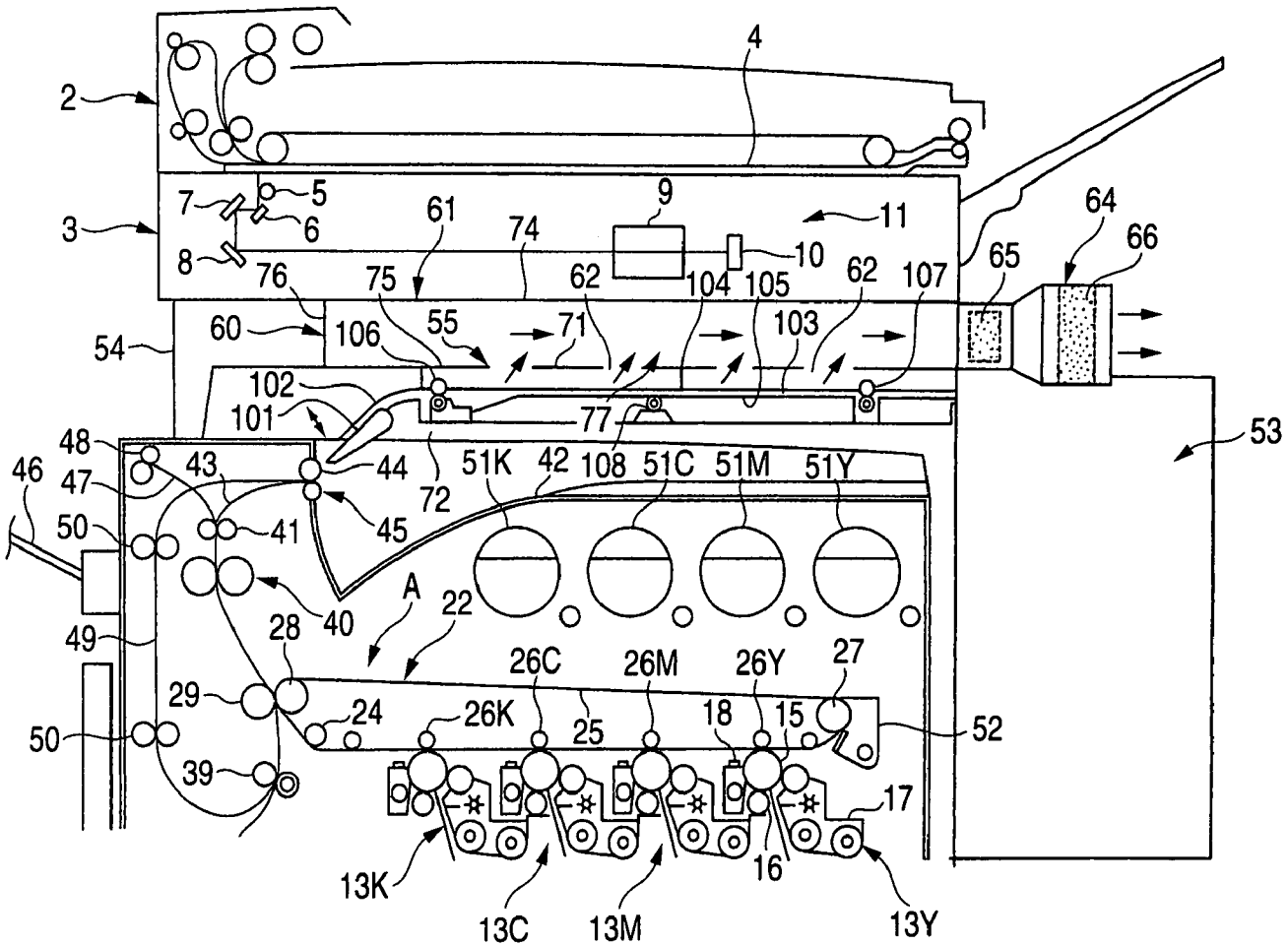
FIG. 15 is a configuration diagram illustrating the main part of a color multifunction machine, which serves as an image forming apparatus according to a sixth exemplary embodiment of the invention.

FIG. 15 shows a sixth exemplary embodiment of the invention. In the following description, the same parts as those of the first exemplary embodiment have the same reference signs. In the sixth exemplary embodiment, the configuration of a transport unit is different from that of the first exemplary embodiment.

In the sixth exemplary embodiment, as shown in FIG. 15, the transport unit 55 is disposed on the top of the main body 1 of the color multifunction machine. The transport unit 55 does not transport the sheet 30, which has been transported above the sheet ejection portion 45 by the transport roll 41, but transports to the post-processing device 53 a sheet 30, which is ejected by a ejection roll 44 disposed on a side surface of the sheet ejection portion 45 as with the normal sheet 30.

As shown in FIG. 15, the transport unit 55 includes a switching gate 101 at the exit portion of the ejection roll 44. The switching gate 101 switches the transport path of the sheet 30 between an upper path and a lower path. A driving unit (not shown) such as a solenoid rotates an end portion of the switching gate 101 on the ejection-roll 44 side along the up-and-down direction. When the sheet 30 on which an image is printed by the color multifunction machine is ejected onto the ejection tray disposed at the upper portion of the main body 1 of the color multifunction machine, the switching gate 101 stops at the position shown in FIG. 15. In this case, the switching gate 101 guides the sheet 30 ejected by the ejection roll 44 to the lower side, that is, to the ejection tray 42.

Figure 16:
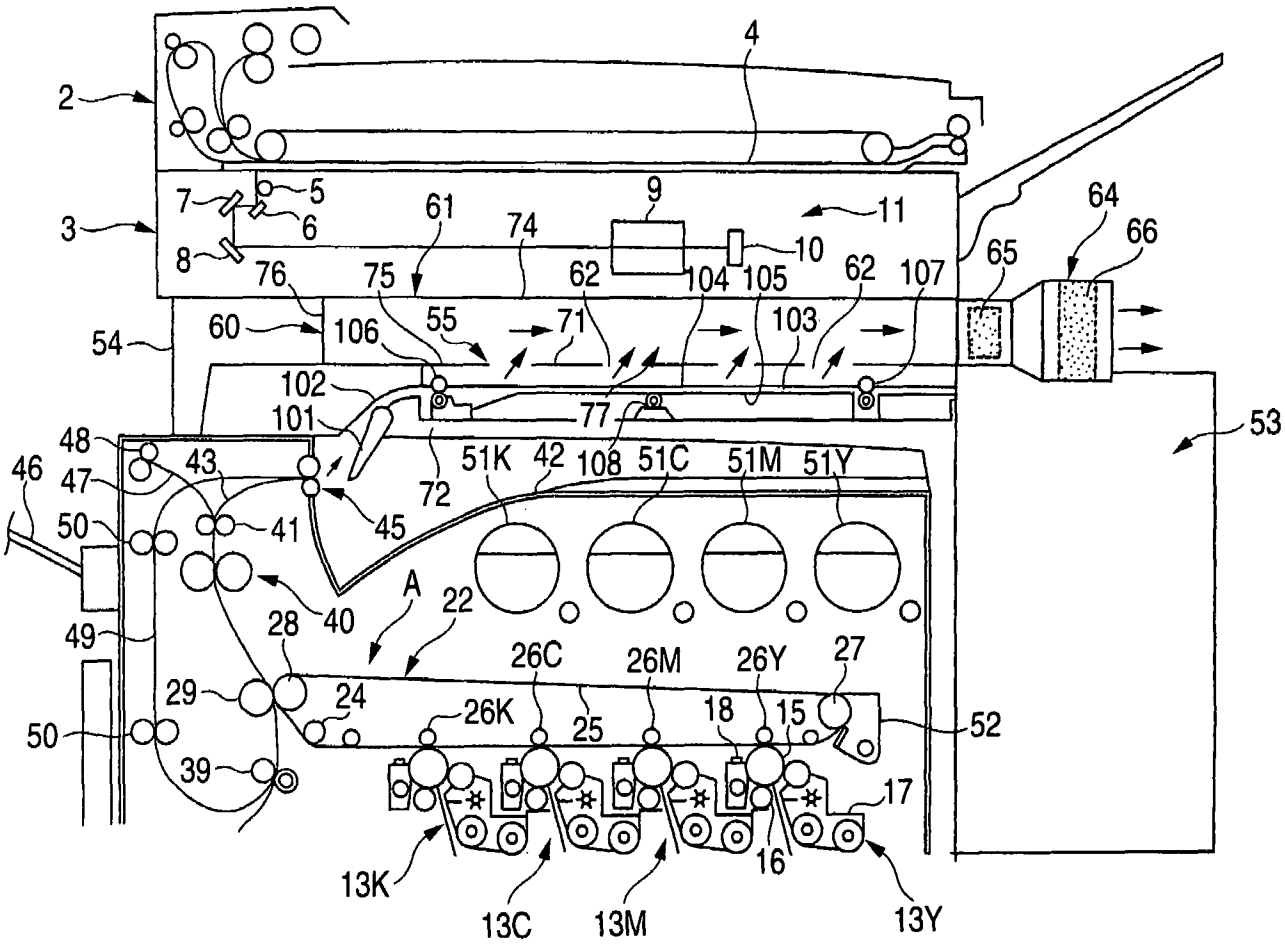
FIG. 16 is a configuration diagram illustrating the main part of the color multifunction machine, which serves as the image forming apparatus according to the sixth exemplary embodiment of the invention.

On the other hand, when the sheet 30 on which an image is printed by the color multifunction machine is transported to the post-processing device 53, the switching gate 101 rotates downward as shown in FIG. 16. In this case, the switching gate 101 guides the sheet 30 ejected by the ejection roll 44 to the upper side, that is, to the transport unit 55.

As described above, the transport unit 55 is fixed to the upper portion of the main body 1 of the color multifunction machine or attached to the upper portion of the main body 1 of the color multifunction machine detachably. A guide plate 102 is disposed at an upper portion of the transport unit 55 on the ejection-roll 44 side. The guide plate 102 has a curved shape and guides the sheet ejected by the ejection roll 44 to the inside of the transport unit 55. Also, a transport path 103 is horizontally provided inside the transport unit 55. The transport path 103 is used to transport the sheet 30 guided by the guide plate 102. The transport path 103 is formed of an upper guide member 104 and a lower guide member 105. In order to transport the sheet 30 along a horizontal direction, the upper and lower guide members 104 and 105 contact the sheet 30 along a traveling direction of the sheet 30. Air is allowed to flow between a surface of the sheet 30 and the upper end surface of the transport unit 55.

Also, as shown in FIG. 15, a pair of first transport rolls 106 are attached to the entrance side of the transport path 103. The first transport rolls 106 transports the sheet 30 with clamping the sheet 30 therebetween. A driving motor (not shown) drives and rotates the first transport rolls 106. Also, a pair of second transport rolls 107 are attached to the exit side of the transport path 103. The second transport rolls 107 transports the sheet 30 with clamping the sheet 30 therebetween. The driving motor (not shown) drives and rotates the second transport rolls 107. Furthermore, a guide roll 108 I provided in a central portion of the transport path 103. In order to reduce a contact resistance between the guide roll 108 and the sheet, the guide roll 108 is provided rotatably only on the lower side of the transport path 103 so as to contact with only the rear surface of the sheet 30.

In the sixth exemplary embodiment, plural suction ports 62 (in FIGS. 15 and 16, four suction ports 62) are formed in the upper surface of the transport unit 55 as in the first exemplary embodiment. Air in the transport path 103 of the transport unit 55 is suctioned through the suction ports 62.

As will be described below, in the color multifunction machine configured as above according to the sixth exemplary embodiment, the image forming apparatus in which the post-processing unit is attached to the apparatus body can prevent disagreeable odor and volatile organic compounds from escaping outside from the transport unit transporting recording media from the apparatus body to the post-processing unit and from affecting the environment where the apparatus is installed.

That is, in the color multifunction machine according to this exemplary embodiment, as shown in FIG. 2, the image forming units 13Y, 13M, 13C and 13K for yellow (Y), magenta (M), cyan (C) and black (K) form yellow (Y), magenta (M), cyan (C) and black (K) toner images, respectively, which are primarily transferred on the intermediate transfer belt in a multilayered manner and then secondarily transferred as a whole image from the intermediate transfer belt 25 onto a sheet of paper 30.

The yellow (Y), magenta (M), cyan (C) and black (K) toner images transferred as a whole image onto the sheet are fixed on the sheet 30 by heating and pressurizing thereof in the fixing unit 40. The sheet 30 is then ejected by the ejection roll 44 from the sheet ejection portion 45 on the face-down tray 42 as a sheet catch tray provided in the upper portion of the main body 1 of the color multifunction machine, which then completes the image forming process.

In this exemplary embodiment, as shown in FIG. 15, adjacent to the main body 1 of the color multifunction machine is installed the post-processing device 53 to provide post-processing such as perforating, binding and the like on the sheet 30 on which the image has been formed in the color multifunction machine.

To perform the post-processing on the sheet 30 in the post-processing unit 53, the switching gate 101 of the transport unit 55 is switched to the lower side as shown in FIG. 16. As a result, when the ejection roll 44 of the sheet ejection portion 45 ejects the sheet 30 on which an image is formed by the color multifunction machine, the sheet 30 is introduced to the inside of the transport unit 55.

As shown in FIG. 16, the first and second transport rolls 106, 107 transport the sheet 30, which is ejected by the ejection roll 44 and introduced to the inside of the transport unit 55 by the switching gate 101, along the transport path 103 formed in the transport unit. The second transport rolls 107 transport the sheet 30 to the inside of the post-processing device 53. Then, the post-processing device 53 performs the predetermined post-processing such as perforating and binding on the sheet 30.

When the yellow (Y), magenta (M), cyan (C) and black (K) toner images undergo a fixing process in which heat and pressure are applied to the sheet 30 in the fixing unit 40, disagreeable odor and volatile organic compounds (VOC) are produced from the toner and the like. As shown in FIG. 16, the odor and volatile organic compounds (VOC) produced from the toner and the like are discharged in the transport unit 55 as the sheet 30 is introduced in the transport unit 55 from the sheet ejection portion 45 through the switching gate 101.

In this exemplary embodiment, as shown in FIG. 16, the suction ports 62 are formed on the upper surface of the top of the transport unit 55. Also, the suction duct 61 is disposed on the transport unit 55. The exhaust fan 65, which is disposed in the exhaust portion 64 of the suction duct 61, is driven.

In this exemplary embodiment, the exhaust fan 65 is driven in synchronization with the start of the image formation operation. The exhaust fan 65 continues to operate for a predetermined period after the image formation operation has completed.

Therefore, although the disagreeable odor and volatile organic compounds, which are produced when the unfixed toner images are fixed on the sheet 30 in the fixing unit 40, are discharged in the transport unit 55 as the sheet 30 moves, the odor and volatile organic compounds discharged in the transport unit 55 are immediately suctioned through the suction ports 62 of the suction duct 61, filtered out through the filter 66 provided in the exhaust portion 64 and discharged through the exhaust fan 65 to the outside of the main body 1 of the color multifunction machine, as shown in FIG. 16.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a main body;

a post-processing unit disposed adjacent to the main body, the post-processing unit that performs predetermined post-processing on a recording medium on which an image is formed in the main body;

a transport unit that transports the recording medium from the main body to the post-processing unit;

a filter; and a suctioning/exhausting unit that suctions air in the transport unit and exhausts the suctioned air through the filter to an outside of the main body, wherein a suction port is formed in a bottom surface of the transport unit, and the suctioning/exhausting unit suctions the air in the transport unit through the suction port.

2. An image forming apparatus comprising:

a main body;

a post-processing unit disposed adjacent to the main body, the post-processing unit that performs predetermined post-processing on a recording medium on which an image is formed in the main body;

a transport unit that transports the recording medium from the main body to the post-processing unit;

a filter;

a suctioning/exhausting unit that suctions air in the transport unit and exhausts the suctioned air through the filter to an outside of the main body a tray; and a recording-medium ejection portion disposed above the transport unit, the recording-medium ejection portion that ejects the recording medium to the tray, wherein:

a suction port is formed in an upper surface of the transport unit, the suctioning/exhausting unit suctions the air in the transport unit through the suction port, and the suctioning/exhausting unit suctions air from a vicinity of the recording-medium ejection portion through the suction port.

3. An image forming apparatus comprising:

a main body including an image forming section that forms an image on a recording medium;

a post-processing unit disposed adjacent to the main body, the post-processing unit that performs predetermined post-processing on the recording medium on which the image is formed by the image forming section of the main body;

a transport unit that transports the recording medium from the main body to the post-processing unit, the transport unit extending above the image forming section of the main body;

a filter;

a suctioning/exhausting unit that suctions air in the transport unit and exhausts the suctioned air through the filter to an outside of the main body; and a recording-medium inverting portion that inverts a recording medium having an image formed on one surface thereof, wherein:

a suction port is formed in an upper surface of the transport unit, the suctioning/exhausting unit suctions the air in the transport unit through the suction port, and the suctioning/exhausting unit suctions air in the recording-medium inverting portion through the suction port.

4. An image forming apparatus comprising:

a main body;

a post-processing unit disposed adjacent to the main body, the post-processing unit that performs predetermined post-processing on a recording medium on which an image is formed in the main body;

a transport unit that transports the recording medium from the main body to the post-processing unit;

a filter;

a suctioning/exhausting unit that suctions air in the transport unit and exhausts the suctioned air through the filter to an outside of the main body; and a tray; and a recording-medium ejection portion disposed below the transport unit, the recording-medium ejection portion that ejects the recording medium to the tray, wherein:

a suction port is formed in a bottom surface of the transport unit, the suctioning/exhausting unit suctions the air in the transport unit through the suction port, and the suctioning/exhausting unit suctions air from a vicinity of the recording-medium ejection portion through the suction port.

5. An image forming apparatus comprising:

a main body;

a post-processing unit disposed adjacent to the main body, the post-processing unit that performs predetermined post-processing on a recording medium on which an image is formed in the main body;

a transport unit that transports the recording medium from the main body to the post-processing unit;

a filter;

a suctioning/exhausting unit that suctions air in the transport unit and exhausts the suctioned air through the filter to an outside of the main body; and a recording-medium inverting portion that inverts a recording medium having an image formed on one surface thereof, wherein:

a suction port is formed in a bottom surface of the transport unit, the suctioning/exhausting unit suctions the air in the transport unit through the suction port, and the suctioning/exhausting unit suctions air in the recording-medium inverting portion through the suction port.

6. The apparatus according to claim 1, wherein the suctioning/exhausting unit suctions the air in the transport unit from a rear side of the transport unit.

7. The apparatus according to claim 6, further comprising:

an operation section that allows a user to input an instruction, wherein:

the rear side of the transport unit is an opposite side to a side where the operation section is disposed, in a direction, which is substantially perpendicular to a direction in which the transport unit transports the recording medium and which is substantially parallel to a surface of the recording medium being transported.

8. The apparatus according to claim 1, further comprising:

an exhaust fan disposed in the transport unit, wherein:

the filter is disposed in the transport unit, and the suctioning/exhausting unit exhausts the air in the transport unit, through the filter.

9. The apparatus according to claim 1, wherein the filter has at least two selected from the group consisting of: (i) a deodorization capability, (ii) a capability of absorbing or decomposing a volatile organic compound and (iii) a capability of absorbing or decomposing ozone.

10. The apparatus according to claim 1, wherein the filter includes at least two selected from the group consisting of: (i) a deodorization filter, (ii) a filter for absorbing or decomposing a volatile organic compound and (iii) a filter for absorbing or decomposing ozone.

11. The image forming apparatus according to claim 1, wherein the suctioning/exhausting unit continues to operate for a predetermined period after the image formation operation has completed.

12. An image forming apparatus comprising:

a main body including an image forming section that forms an image on a recording medium;

a post-processing unit disposed adjacent to the main body, the post-processing unit that performs predetermined post-processing on the recording medium on which the image is formed by the image forming section of the main body;

a transport unit that transports the recording medium from the main body to the post-processing unit, the transport unit extending above the image forming section of the main body;

a filter; and means for suctioning air in the transport unit and for exhausting the suctioned air through the filter to an outside of the main body.

* * * * *